US008897459B2

(12) United States Patent
Yamkovoy

(10) Patent No.: US 8,897,459 B2
(45) Date of Patent: Nov. 25, 2014

(54) TWO-WAY AUDIO COMMUNICATION SYSTEM WITH REDUCED GROUND NOISE

(75) Inventor: Paul G. Yamkovoy, Acton, MA (US)

(73) Assignee: Bose Corporation, Framingham, MA (US)

( * ) Notice: Subject to any disclaimer, the term of this patent is extended or adjusted under 35 U.S.C. 154(b) by 336 days.

(21) Appl. No.: 13/610,937

(22) Filed: Sep. 12, 2012

(65) Prior Publication Data

US 2014/0072138 A1 Mar. 13, 2014

(51) Int. Cl.
*H04R 1/10* (2006.01)
*H04R 5/00* (2006.01)

(52) U.S. Cl.
USPC ..... 381/74; 381/26; 381/122; 381/375

(58) Field of Classification Search
None
See application file for complete search history.

(56) References Cited

U.S. PATENT DOCUMENTS

| | | | | |
|---|---|---|---|---|
| 3,632,886 | A * | 1/1972 | Scheiber | 381/22 |
| 5,118,309 | A | 6/1992 | Ford | |
| 6,078,825 | A | 6/2000 | Hahn et al. | |
| 6,885,754 | B2 | 4/2005 | Lazzeroni et al. | |
| 6,970,727 | B1 | 11/2005 | Klein | |
| 7,157,917 | B2 | 1/2007 | Nakashita et al. | |
| 7,187,948 | B2 | 3/2007 | Alden | |
| 7,340,284 | B2 | 3/2008 | Chung | |
| 7,561,700 | B1 * | 7/2009 | Bernardi et al. | 381/92 |
| 8,075,342 | B1 | 12/2011 | Harney et al. | |
| 2005/0288067 | A1 | 12/2005 | Wainwright | |
| 2007/0287380 | A1 | 12/2007 | Hui et al. | |
| 2008/0004089 | A1 | 1/2008 | Huizer et al. | |
| 2010/0087218 | A1 | 4/2010 | Hannosh et al. | |

FOREIGN PATENT DOCUMENTS

| | | | |
|---|---|---|---|
| GB | 787702 | A | 12/1957 |
| WO | 200438869 | A1 | 5/2004 |

OTHER PUBLICATIONS

Invitation to Pay Additional Fees dated Jan. 2, 2014 for International application No. PCT/US2013/059161.

Drolet, Michael, "Production Intercom System," Apr. 16, 2008, XP002717318, Retrieved from the Internet URL: http://jac.michaeldrolet.net/intercom/PRODCM.htm [retrieved on Dec. 2, 2013], figures 6-7.

International Search Report and Written Opinion dated Feb. 4, 2014 for International application No. PCT/US2013/059161.

* cited by examiner

*Primary Examiner* — Daniell L Negron

(57) ABSTRACT

An audio communication system includes a headset with a microphone having two electrical outputs and a first electro-acoustic driver. The system includes first and second differential amplifiers, and a first electrical conductor for electrically connecting an output of the first differential amplifier with a first audio source device. A second electrical conductor is provided for electrically connecting an input of the driver with the first audio source device. A third electrical conductor is provided for electrically connecting an output of the second differential amplifier with a second audio source device. A fourth electrical conductor is provided for electrically connecting an input of the driver with the second audio source device. One electrical output from the microphone is electrically connected to a positive input of each of the differential amplifiers. The other electrical output from the microphone is electrically connected to a negative input of each of the differential amplifiers.

20 Claims, 8 Drawing Sheets

TWO-WAY AUDIO COMMUNICATION SYSTEM WITH REDUCED GROUND NOISE

BACKGROUND

This disclosure relates to an audio communication system with a headset for two-way audio communication. If the electrical architecture of the system is not arranged properly, the system can suffer from problems such as ground noise (e.g. ground bounce) wireless electromagnetic noise, and side tone feedback.

SUMMARY

In one aspect, an audio communication system includes a headset with a microphone having two electrical outputs and a first electro-acoustic driver. The system also includes first and second differential amplifiers, as well as a first electrical conductor for electrically connecting an output of the first differential amplifier with a first audio source device. A second electrical conductor is provided for electrically connecting an input of the driver with the first audio source device. A third electrical conductor is provided for electrically connecting an output of the second differential amplifier with a second audio source device. A fourth electrical conductor is provided for electrically connecting an input of the driver with the second audio source device. One electrical output from the microphone is electrically connected to a positive input of each of the differential amplifiers. The other electrical output from the microphone is electrically connected to a negative input of each of the differential amplifiers.

Embodiments may include one or more of the following features. The output of the first amplifier is provided to an input of a side tone circuit. An output of the side tone circuit is provided to the input of the driver. The output of the second amplifier is provided to an input of the second side tone circuit. An output of the second side tone circuit is provided to the input of the driver. The system may include a bias voltage detection circuit. When the detection circuit determines that the first conductor is electrically connected to an audio source with a bias voltage above zero, the detection circuit cause a gain decrease in the first differential amplifier. The first amplifier is contained within a first connector at the end of a first cable. The second amplifier is contained within a second connector at the end of a second cable. The microphone is a dynamic microphone. The system may further include a second electro-acoustic driver in which an input of the second driver is electrically connected with the first audio source device via the second electrical conductor.

In another aspect, audio communication cables for use in an audio communication system include a first cable and a first differential amplifier. The cable is electrically connectable to a headset such that positive and negative inputs of the amplifier are electrically connected to a microphone of the headset. An output of the amplifier is connectable with a first audio source device. The audio source device is connectable with an input of an electro-acoustic driver of the headset via the cable. A second cable and a second differential amplifier are included. The second cable is connectable to the headset such that positive and negative inputs of the second amplifier are electrically connected to the microphone of the headset. An output of the second amplifier is connectable with a second audio source device. The second audio source device is connectable with the driver of the headset via the second cable.

Embodiments may include any of the above features and/or the following. The cables may further including a bias voltage detection circuit. When the detection circuit determines that the first cable is connected to an audio source with a bias voltage above zero, the detection circuit cause a gain decrease in the first differential amplifier. The first amplifier is part of the first cable. The second amplifier is part of the second cable. The cables may further include a second electro-acoustic driver. An input of the second driver is electrically connected with the first audio source device via the first cable.

In another aspect, an audio communication system includes a headset with a microphone having two electrical outputs. The system also includes first and second differential amplifiers, a bias voltage detection circuit, and first and second electrical conductors. The first conductor electrically connects an output of the first differential amplifier with a first audio source device. The second conductor electrically connects an output of the second differential amplifier with a second audio source device. One electrical output from the microphone is electrically connected to a positive input of each of the differential amplifiers. The other electrical output from the microphone is electrically connected to a negative input of each of the differential amplifiers. When the detection circuit determines that the headset is connected to an audio source with a bias voltage above zero, the detection circuit cause a gain decrease in the first differential amplifier.

Embodiments may include any of the above features and/or the following. The first amplifier is part of a first connector towards the end of a first cable. The second amplifier is part of a second connector towards the end of a second cable. The system further includes an electro-acoustic driver. An input of the driver is electrically connected with the first audio source device via a third electrical conductor.

DETAILED DESCRIPTION

Issues can arise when trying to interface a single microphone (headset's boom mic) with multiple communication devices (e.g. radios, intercoms). When attempting to connect a single electret microphone to multiple communication devices, for example, the equivalent load resistance for the microphone drops (parallel connection of multiple loads) resulting in a loss of output signal (loss of sensitivity). In addition, different types of microphones will cause issues if they are connected with each other (e.g. a dynamic microphone cannot be connected to an electret microphone input and vice-versa).

What is disclosed and what is claimed herein is intended to be applicable to a wide variety of communications headsets, i.e., devices structured to be worn on or about a user's head in a manner in which at least one acoustic driver is positioned in the vicinity of an ear, and in which a microphone is positioned towards the user's mouth to enable two-way audio communications. It should be noted that although specific embodiments of communications headsets incorporating a pair of acoustic drivers (one for each of a user's ears) are presented, such presentations of specific embodiments are intended to facilitate understanding through examples, and should not be taken as limiting either the scope of disclosure or the scope of claim coverage.

It is intended that what is disclosed and what is claimed herein is applicable to headsets that also provide active noise reduction (ANR), passive noise reduction (PNR), or a combination of both. It is intended that what is disclosed and what is claimed herein is applicable to headsets meant to be coupled to at least an intercom system (ICS) or radio through a wired connection, but which may be further structured to be connected to any number of additional devices. It is intended that what is disclosed and what is claimed herein is applicable to headsets having physical configurations structured to be worn in the vicinity of either one or both ears of a user, including and not limited to, over-the-head headsets with either one or two earpieces, behind-the-neck headsets, two-piece headsets incorporating at least one earpiece and a physically separate microphone worn on or about the neck, as well as hats or helmets incorporating earpieces and microphone(s) to enable audio communication. Still other embodiments of headsets to which what is disclosed and what is claimed herein is applicable will be apparent to those skilled in the art.

Figure 1:
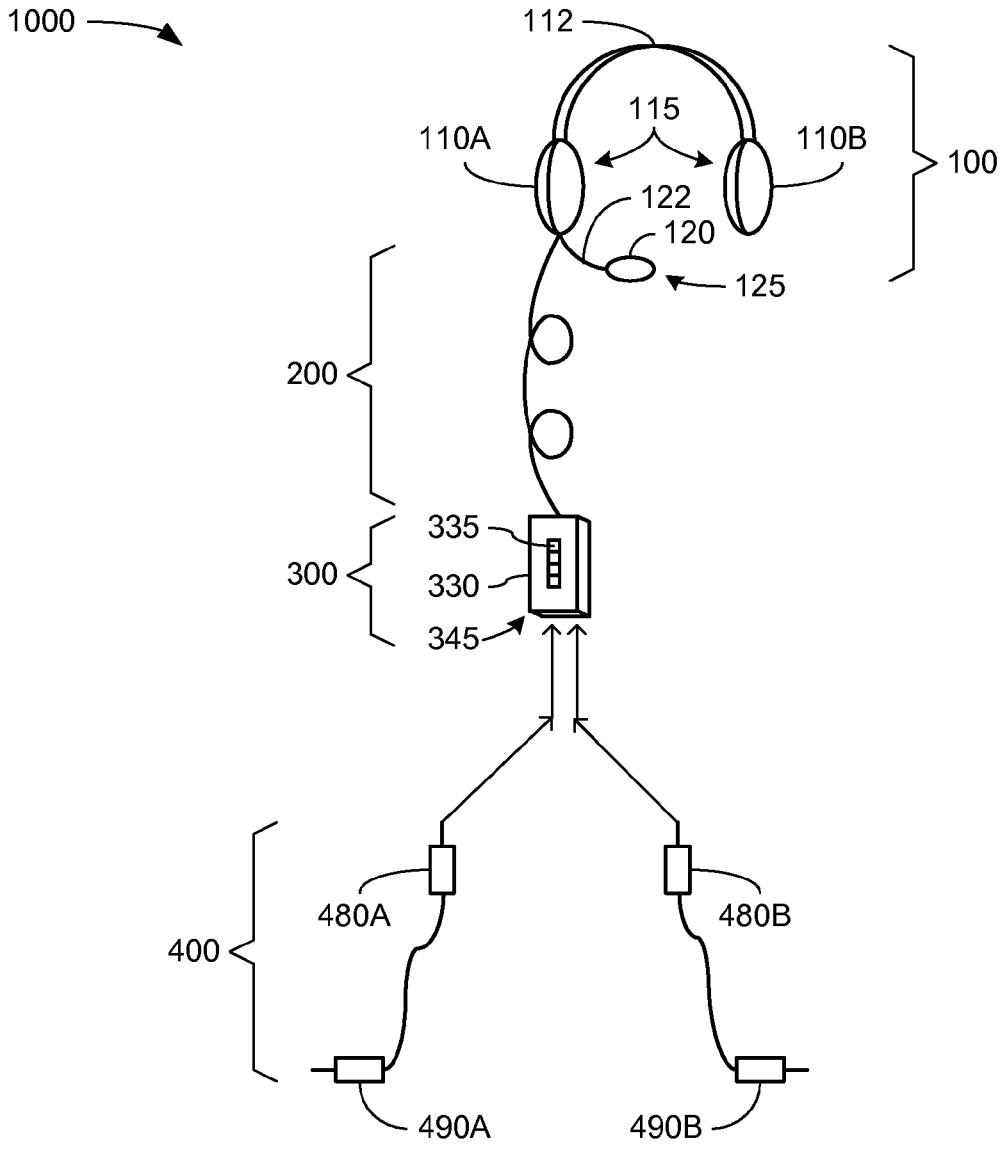
FIG. 1 is a perspective diagram of a communications headset.

FIG. 1 depicts an embodiment of an audio communications system 1000 meant to be coupled to an audio source device, such as an ICS or radio. The system 1000 incorporates a headset assembly 100, an upper cable 200, a control box 300, and lower cables 400. The headset assembly 100 incorporates a pair of earpieces 110A, 110B that each incorporate one of a pair of electro-acoustic drivers 115, a headband 112 that couples together the earpieces 110A, 110B, a microphone boom 122 extending from one of the earpieces 110A, 110B, and a microphone casing 120 supported by the microphone boom 122 and incorporating a communications microphone 125 (preferably a dynamic microphone). As depicted, the communications system 1000 has an "over-the-head" physical configuration commonly found among communications headsets employed in airplanes, helicopters, military vehicles, etc. Depending on the size of each of the earpieces 110A, 110B relative to the typical size of the pinna of a human ear, each of the earpieces 110A, 110B may be either an "on-ear" (also commonly called "supra-aural") or an "around-ear" (also commonly called "circum-aural") form of earcup. However, despite the depiction in FIG. 1 of this particular physical configuration of the headset assembly 100, those skilled in the art will readily recognize that the head assembly may take any of a variety of other physical configurations, including physical configurations having only one of the earpieces 110A, 110B (and correspondingly, only one of the acoustic drivers 115), physical configurations employing a napeband meant to extend between the earpieces 110A, 110B about the back of a user's neck, and/or physical configurations having no band at all.

The control box 300 incorporates a casing 330 that incorporates one or more manually-operable controls 335 enabling a user of the communications system 1000 to manually control aspects of various functions performed by the communications system 1000. For example, the manually-operable controls 335 may enable a user of the system 1000 to coordinate the transfer of audio between the system 1000 and the audio source devices to which the system 1000 may be coupled via the lower cable 400. The control box may further incorporate at least a compartment (not shown) for a battery 345 and/or the battery 345, itself.

The upper cable 200 is made up principally of a multiple-conductor electrical cable extending between and coupling one of the earpieces 110A, 110B of the headset assembly 100 to the control box 300. In so doing, at least a subset of the conductors of the upper cable 200 couple and convey electrical signals (including electric power) between the headset assembly 100 and the control box 300. In various possible variants of the communications system 1000, the upper cable 200 may be formed with a coiled shape as a convenience to users of the headset 1000. Also, in various possible variants of the communications system 1000, the upper cable 200 may additionally incorporate one or more connectors (not shown) on the upper cable 200 where the upper cable 200 is coupled to one of the earpieces 110 and/or where the upper cable 200 is coupled to the casing 330 of the control box 300, thereby making the upper cable 200 detachable from one or both of the headset assembly 100 and the control box 300.

The lower cables 400 are each made up principally of another multiple-conductor electrical cable extending from the control box 300, different variants of which end with one or more connectors 490A, 490B (two variants being depicted) that are meant to enable the communications system 1000 to be detachably coupled to any of a variety of audio source devices (e.g., an ICS and/or radio, not shown). In so doing, at least a subset of the conductors of the lower cables 400 couple and convey electrical signals (including electric power) between the control box 300 and circuitry of whatever audio source device to which the connectors 490A, 490B may be coupled. Not unlike the upper cable 200, in various possible variants, the lower cables 400 may be formed with a coiled shape as a convenience to users of the system 1000. Also, in various possible variants of the communications system 1000 the lower cable 400*s* may additionally incorporate one or more connectors 480A, 480B where the lower cables 400 are each coupled to a connector (not shown) of the control box 300, thereby making the lower cables 400 detachable from the control box 300.

Figure 2:
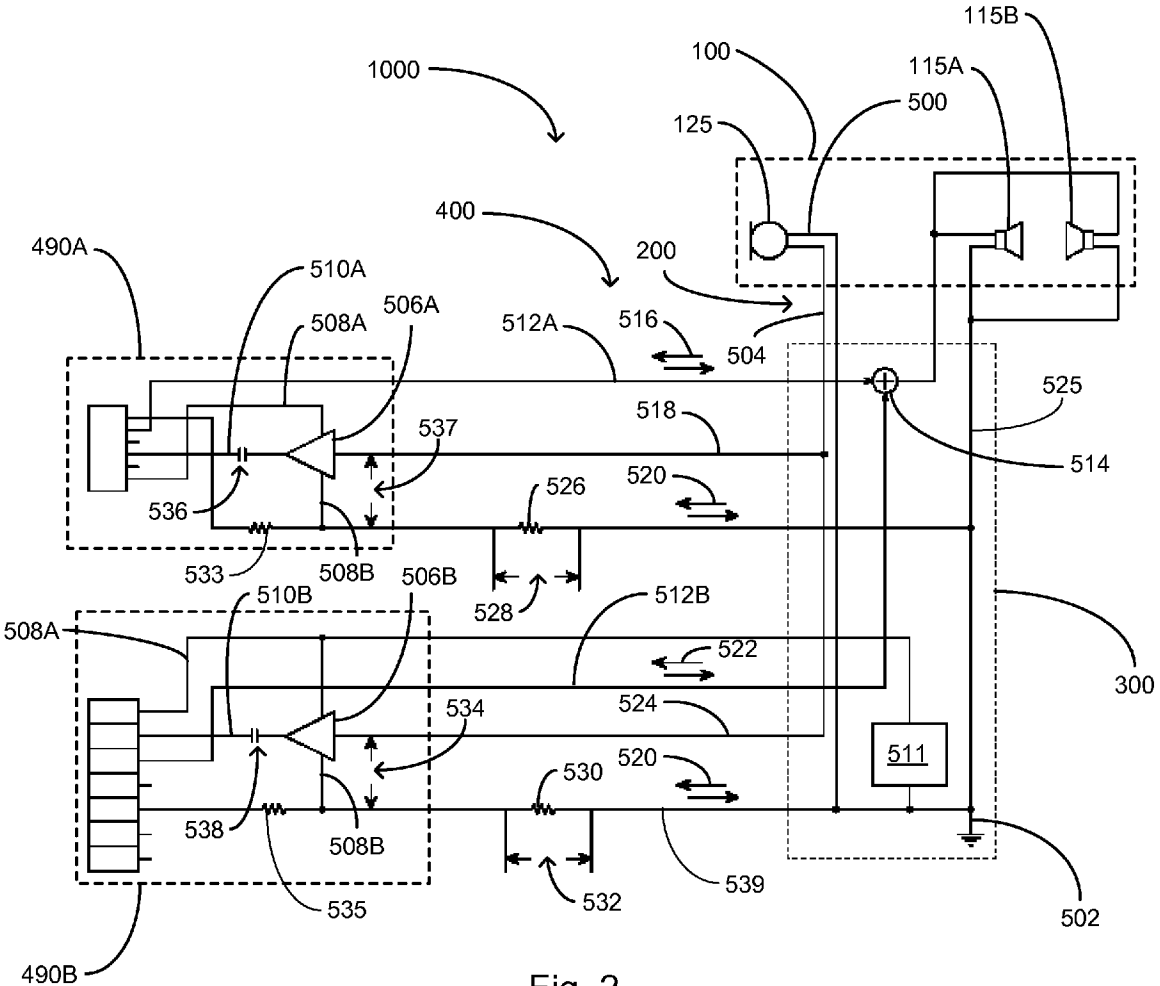
FIG. 2 is a block diagram of a possible electrical architecture of the communications headset of FIG. 1.

Turning to FIG. 2, the electrical architecture of the system 1000 of FIG. 1 includes the headset assembly 100, the upper cable 200, the control box 300, the lower cables 400 and the connectors 490A, 490B. The connectors 480A and 480B are not shown to avoid over-cluttering FIGS. 2-6. The microphone 125 has two electrical outputs which are a mic-low conductor 500 connected to ground 502 and a mic-high conductor 504 that is connected to amplifiers 506A, 506B in respective connectors 490A, 490B. Each amplifier 506A, 506B is also connected to power and ground respectively at 508A, 508B. Electrical conductors 510A and 510B electrically connect an output of respective amplifiers 506A and 506B with a respective audio source device (not shown). Each amplifier 506A and 506B is contained within a respective connector 490A and 490B which is located at an end of one of the cables 400. The amplifiers 506A and 506B (as well as the differential amplifiers described below) can be located at other positions along the cables 400. Power is also supplied on conductor 508B to active power loads 511 which are electronic power consuming circuits located between an audio source device connected to connector 490B and the speakers 115A and 115B (e.g. amplifiers, active noise reduction circuitry, and active equalization circuits). Audio from audio source devices (e.g. ICS or radio) connected respectively to the connectors 490A, 490B is passed along electrical conductors 512A, 512B to a summer 514 and then further conducted to an input of the drivers 115A, 115B. Each of the drivers 115A, 115B is also electrically connected to ground 502.

The current at 516 is given as I_AUD1. The voltage at 518 is given as V_Mic_SigH. The current at 520 is given as I_GND_RET. The current at 522 is given as I_AUD2. The voltage at 524 is given as V_Mic_SigH. The current at 525 is given as I_AUD_Ret. The ground impedance Z_GND1 is represented by a resistor 526 which has a voltage drop 528 of V_GND1 across this resistor. The ground impedance Z_GND2 is represented by a resistor 530 which has a voltage drop 532 of V_GND2 across this resistor. The ground impedance Z_GND1' is represented by a resistor 533 which has a voltage drop of V_GND1' across this resistor. The ground impedance Z_GND2' is represented by a resistor 535 which has a voltage drop of V_GND2' across this resistor. Capacitors are located at 536 and 538. An output voltage of the amplifier 506A is given as the input voltage 537×GAIN which is ((V_Mic_Sig+)+V_GND1)×GAIN. An output voltage of the amplifier 506B is given as the input voltage 534× GAIN which is ((V_Mic_Sig+)+V_GND2)×GAIN.

An issue with this arrangement is that the amplifier output voltages include ground noise. A component of I_GND_RET consists of I_AUD_RET and the AC component of the power ground return which can cause ground bounce problems. These issues can degrade the quality of the two-way audio communications. Due to the impedance 530 being greater than 0 Ohm in a conductor 539, any current across the conductor 539 will develop a voltage drop across it (per Ohm's law V=I*Z). Since the output of the amplifier 506B is given as Vo=Vin*Gain, and Vin is equal to electric potential difference 534 between the conductor 539 and the input terminal of the amplifier 506B, the actual output of the amplifier 506B will be Vo=(Vi+V_GND1)*Gain. V_GND1 is a "ground bounce" noise that can degrade the quality of the two-way audio communications.

Figure 3:
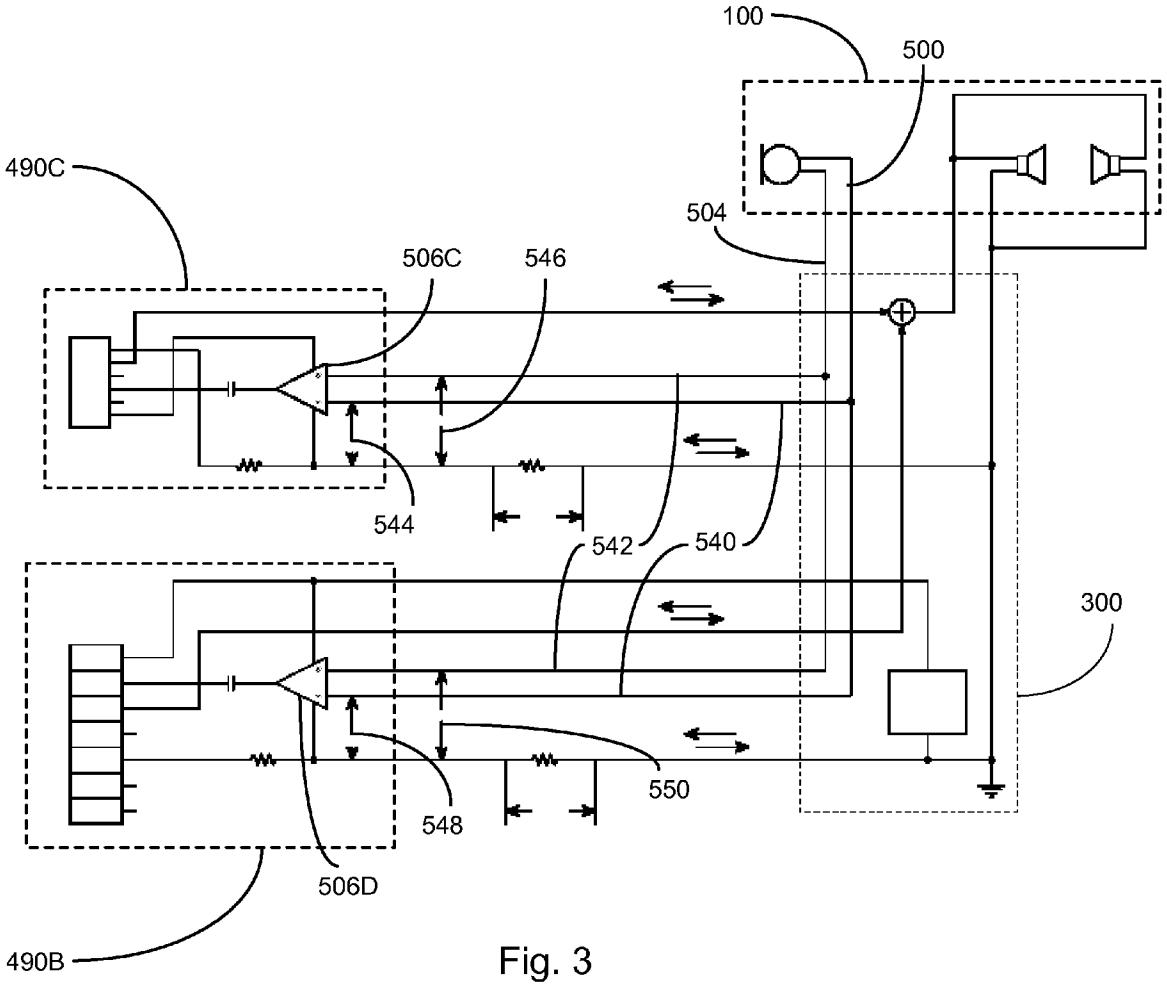
FIG. 3 is a block diagram of one variant of the electrical architecture of FIG. 2.

FIG. 3 shows a modification to the electrical architecture shown in FIG. 2. Most of the components in FIG. 3 will not be labeled as they are the same as in FIG. 2. The main difference between FIGS. 2 and 3 is that (a) the amplifiers 506A and 506B of FIG. 2 have been replaced with differential amplifiers 506C and 506D, (b) the mic-low conductor 500 is connected to the negative inputs of the differential amplifiers 506C and 506D, and (c) the mic-high conductor 504 is connected to the positive inputs of the differential amplifiers 506C and 506D. A differential amplifier will act as a buffer with very low (ideally 0 Ohm) source impedance. The low source impedance of the differential amplifier allows supplying multiple loads (inputs of multiple communication devices) without degradation of the microphone signal.

The voltage at 540 is given as V_Mic_Low and the voltage at 542 is given as V_Mic_High. The voltage at 544 is given as V_Mic_Low+V_GND1 and the voltage at 546 is given as V_Mic_High+V_GND1. So the output voltage of the differential amplifier 506C is (V_Mic_High+V_GND1−V_Mic_Low−V_GND1)×GAIN. This equation reduces to (V_Mic_High−V_Mic_Low)×GAIN. The voltage at 548 is given as V_Mic_Low+V_GND2 and the voltage at 550 is given as V_Mic_High+V_GND2. So the output voltage of the differential amplifier 506D is (V_Mic_High+V_GND2−V_Mic_Low−V_GND2)×GAIN. This equation reduces to (V_Mic_High−V_Mic_Low)×GAIN. As a result, the ground noise (ground bounce) has been eliminated from the output of the differential amplifiers 506C and 506D. This arrangement results in higher quality two-way audio communications.

Figure 4:
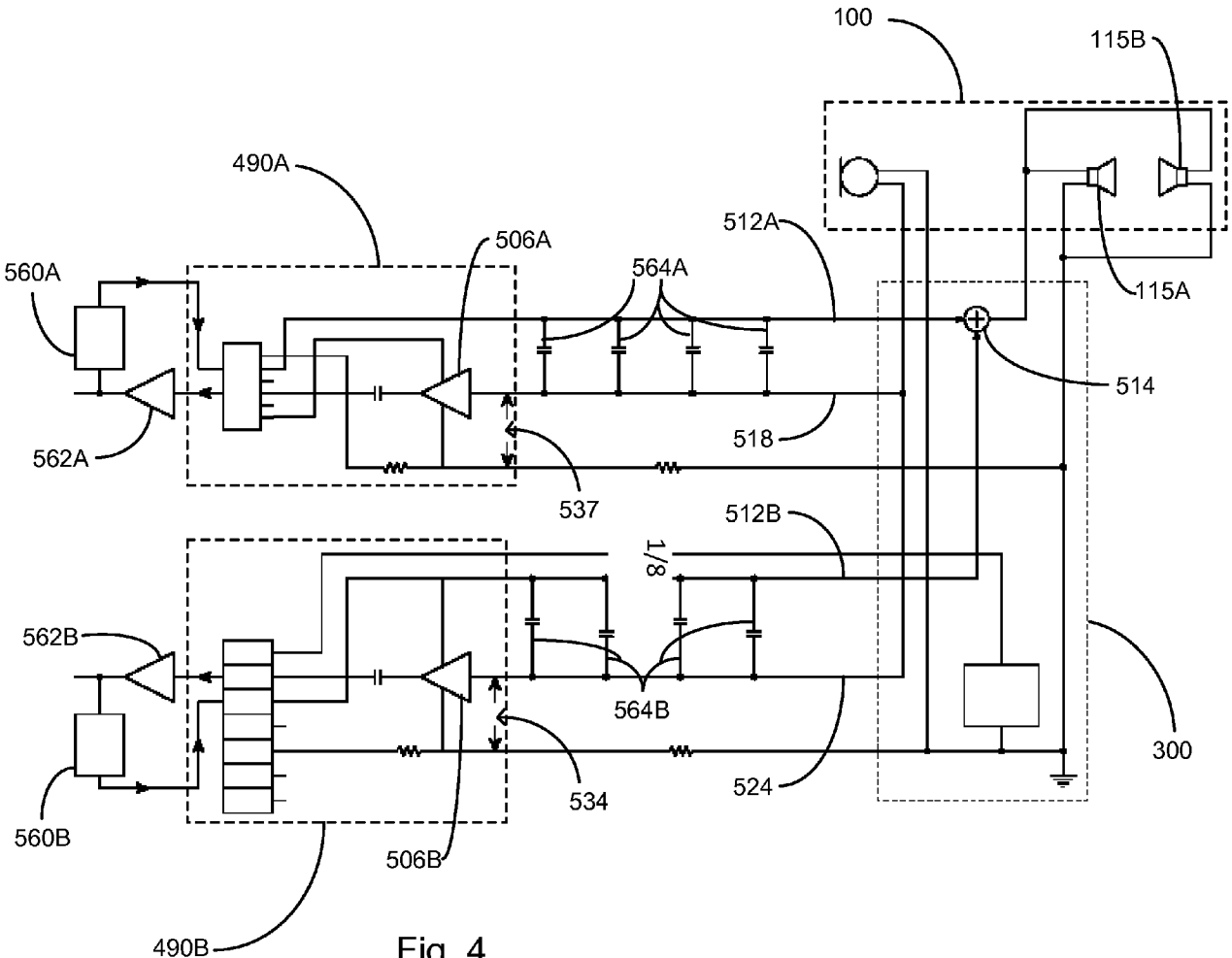
FIG. 4 is a block diagram of another possible electrical architecture of the communications headset of FIG. 1.

FIG. 4 shows a modification to the electrical architecture shown in FIG. 2. Most of the components in FIG. 4 will not be labeled as they are the same as in FIG. 2. The main difference between FIGS. 2 and 4 is that side tone circuits 560A and 560B as well as amplifiers 562A and 562B have been added to the architecture. An output of the amplifier 506A is provided to the amplifier 562A which provides its output to the input of the side tone circuit 560A. An output of the side tone circuit 560A is provided to the summer 514 The summer 514 provides the signal to the input of the drivers 115A and 115B so that the wearer of the headset 1000 (FIG. 1) will be able to hear what they are saying into the microphone 125. The side tone circuit 560B and the amplifier 562B operate in the same way.

A problem with this arrangement is that parasitic coupling, represented by capacitors 564A and 564B, occurs between conductors 512A and 518 as well as between conductors 512B and 524. In effect, a parasitic (unwanted) positive feedback may occur which may result in oscillation (instability) of the amplifier circuit 506 and/or 562 (similar to the effect of placing a microphone in front of a speaker). This may result in an undesirable squealing sound (oscillation, instability, etc) produced by the drivers 115A and 115B. The microphone feedback signal causes a voltage on the input conductor to the amplifier which is given as V_Crosstalk. The voltage 537 is given as (V_Mic_Sig+)+V_GND1+V_Crosstalk1 which results in a voltage out of the amplifier 506A of V_OUT=((V_Mic_Sig+)+V_GND1+V_Crosstalk1)×GAIN. The voltage drop 534 is given as (V_Mic_Sig+)+V_GND2+V_Crosstalk2 which results in a voltage out of the amplifier 506B of V_OUT=((V_Mic_Sig+)+V_GND2+V_Crosstalk2)×GAIN. This distortion degrades the quality of the two-way audio communications.

Figure 5:
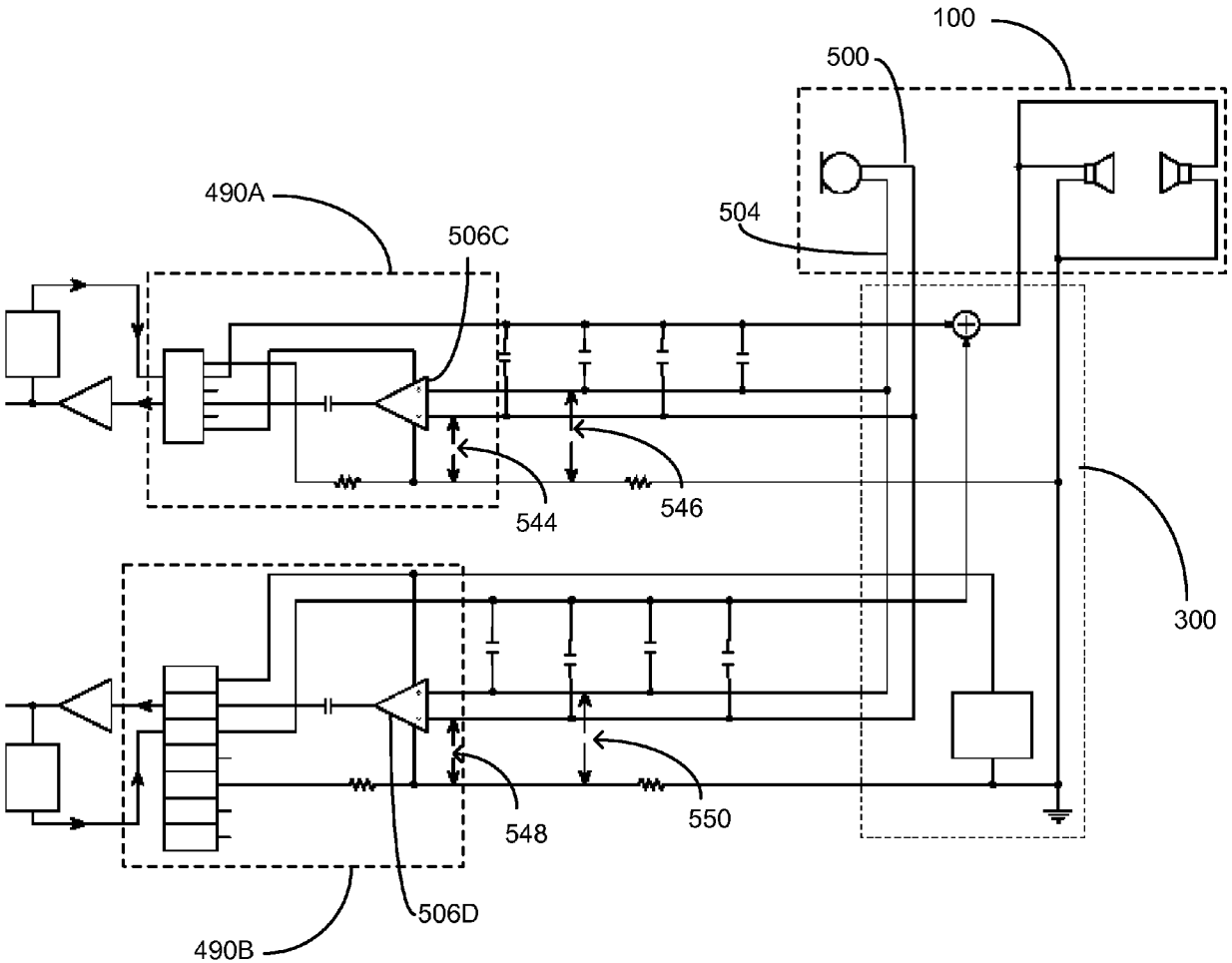
FIG. 5 is a block diagram of one variant of the electrical architecture of FIG. 4.

FIG. 5 shows a modification to the electrical architecture shown in FIG. 4. Most of the components in FIG. 5 will not be labeled as they are the same as in FIG. 4. The main difference between FIGS. 4 and 5 is that (a) the amplifiers 506A and 506B of FIG. 4 have been replaced with differential amplifiers 506C and 506D, (b) the mic-low conductor 500 is connected to the negative inputs of the differential amplifiers 506C and 506D, and (c) the mic-high conductor 504 is connected to the positive inputs of the differential amplifiers 506C and 506D. The voltage at 544 is given as V_Mic_Low+V_GND1+V_CrossTalk1 and the voltage at 546 is given as V_Mic_High+V_GND1+V_CrossTalk1. So the output voltage of the differential amplifier 506C is (V_Mic_High+V_GND1+V_CrossTalk1−V_Mic_Low−V_GND1−V_CrossTalk1)×GAIN. This equation reduces to (V_Mic_High−V_Mic_Low)×GAIN. The voltage at 548 is given as V_Mic_Low+V_GND2+V_CrossTalk2 and the voltage at 550 is given as V_Mic_High+V_GND2+V_CrossTalk2. So the output voltage of the differential amplifier 506D is (V_Mic_High+V_GND1+V_CrossTalk2−V_Mic_Low−V_GND2−V_CrossTalk2)×GAIN. This equation reduces to (V_Mic_High−V_Mic_Low)×GAIN. As a result, the microphone feedback caused by parasitic coupling of the conductors has been eliminated from the output of the differential amplifiers 506C and 506D. This arrangement results in higher quality two-way audio communications.

Figure 6:
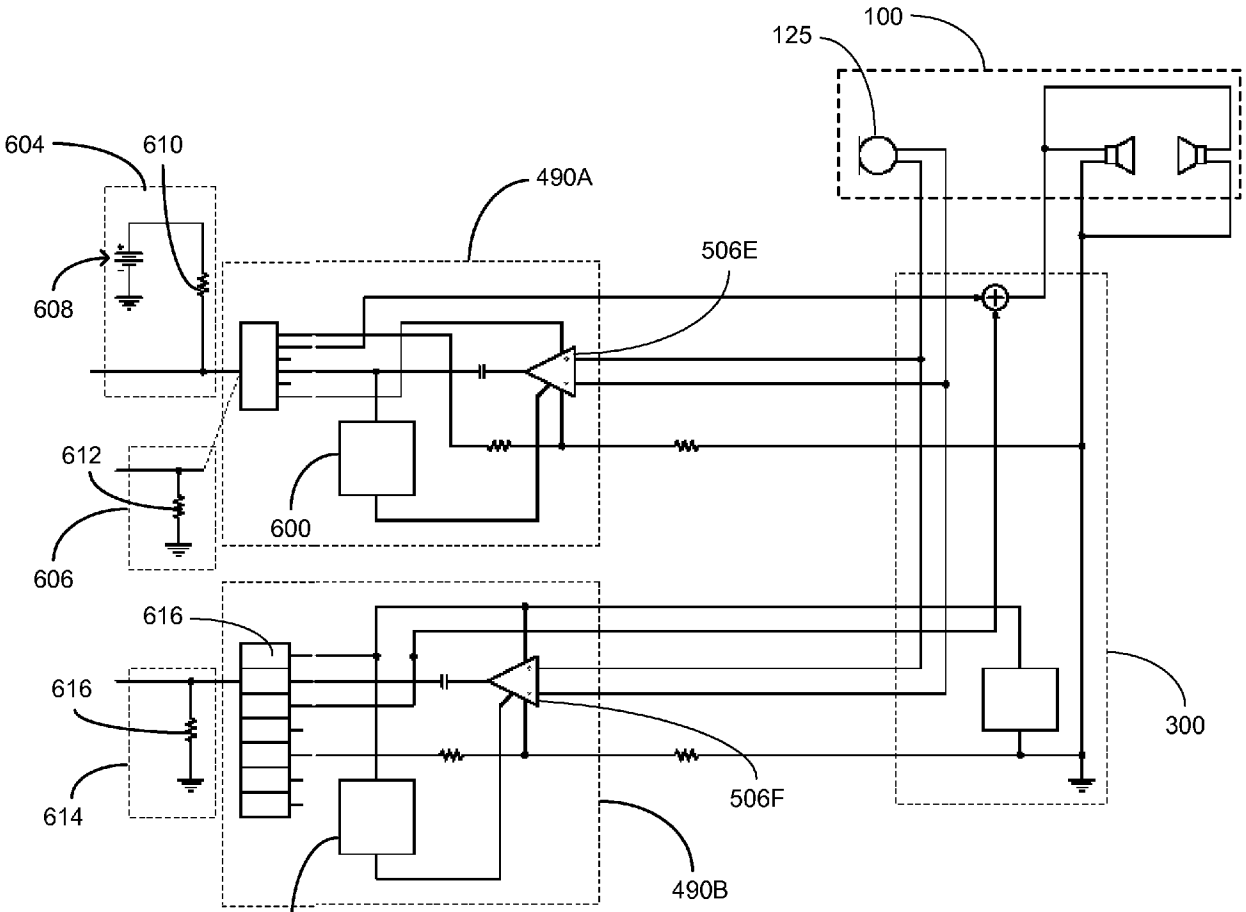
FIG. 6 is a block diagram of another possible electrical architecture of the communications headset of FIG. 1.

FIG. 6 shows a modification to the electrical architecture shown in FIG. 3. Most of the components in FIG. 6 will not be labeled as they are the same as in FIG. 3. A voltage bias detection circuit 600 has been added to the connector 490A and a voltage power level circuit 602 has been added to the connector 490B. The connector 490A can interface with an audio source device 604 that includes an electret microphone or an audio source device 606 that includes a dynamic microphone. The audio device 604 includes a bias voltage 608 and a bias resistor 610. The audio device 606 includes an input resistor 612.

When the audio device 604 is electrically connected to the connector 490A, the circuit 600 will detect the bias voltage from the audio device 604 and determine that the bias voltage is above zero. In this case, the circuit 600 causes the gain of a differential amplifier 506E to decrease. This is because the presence of a bias voltage indicates that the audio device 604 (source) expects an electret type of microphone (that requires a bias voltage). Electret microphones deliver greater signal (e.g. +24 dB greater than 150 Ohm dynamic microphone) and require less gain.

When the audio device 606 is electrically connected to the connector 490A, a bias voltage is not detected by the circuit 600. This indicates that the audio device 606 expects a dynamic type microphone that requires greater gain from the amplifier 506E. This is how system "adaptivity" to a type of microphone is achieved without user interaction. All of the above can be summarized as follows. When no bias voltage is detected by the circuit 600, the amplifier 506E is set to operate a dynamic microphone (e.g. +24 dB of gain, that may also be different depending on the actual dynamic mic sensitivity). When the circuit 600 detects a bias voltage, the gain of the amplifier 506E is set to 0 dB.

The connector 490B can interface with an audio source device 614 (e.g. a walkie-talkie) that includes a dynamic microphone. The audio device 614 includes an input resistor 616. This is an example where the microphone signal level (not the type of microphone) can be determined by sensing the presence (or level) of an external power source. In general, military vehicle intercoms provide electric power which can be supplied to active noise reduction headsets (unlike radios that do not supply such power). The circuit 602 senses the voltage and/or its level out of a power pin 616 which indicates what type of communication device (radio or intercom) and microphone signal level is expected. The circuit 602 adjusts the gain of an amplifier 506F to +24 dB if an electret microphone signal is expected or to 0 dB if a dynamic microphone signal is expected. The headset 100 in this example has a dynamic microphone 125 but delivers the signal levels of an electret microphone (adding +24 dB) or dynamic microphone (adding 0 dB) adaptively as needed. It is relevant here because some military high RF power communication systems employ dynamic microphones (due to their greater EMI immunity), but may also operate with electret microphones. Such systems may not provide a microphone bias voltage but may still expect an electret microphone signal level.

One example is a VIC-3 intercom by Northrop-Grumman which works as follows. The intercom 614 supplies the control box 300 and headset 100 with electrical power via the top-most pin 616, thus signaling the presence of the intercom. The voltage detector circuit 602 detects the external power and sets the gain of the amplifier 506F to +24 dB. The control box 300 pulls extra current (say 40 mA) from the intercom, signaling the intercom about the microphone signal level being set to electret microphone level (added 24 dB). The intercom 614 senses the current consumption by the control box 300/headset 100 and adjusts the intercom's internal gain to accommodate the electret microphone signal level. In a different scenario, the intercom voltage may not be present or be below the threshold of the circuit 602, resulting in the gain of the amplifier 506F being set to 0 dB. In this case the current from the intercom being pulled by the control box 300/headset 100 would be under 40 mA signaling the intercom about a dynamic microphone signal level. The intercom 614 senses a current under 40 mA being drawn by the control box 300/headset 100 and adjusts its internal gain to accommodate a dynamic microphone signal level.

Figure 7:
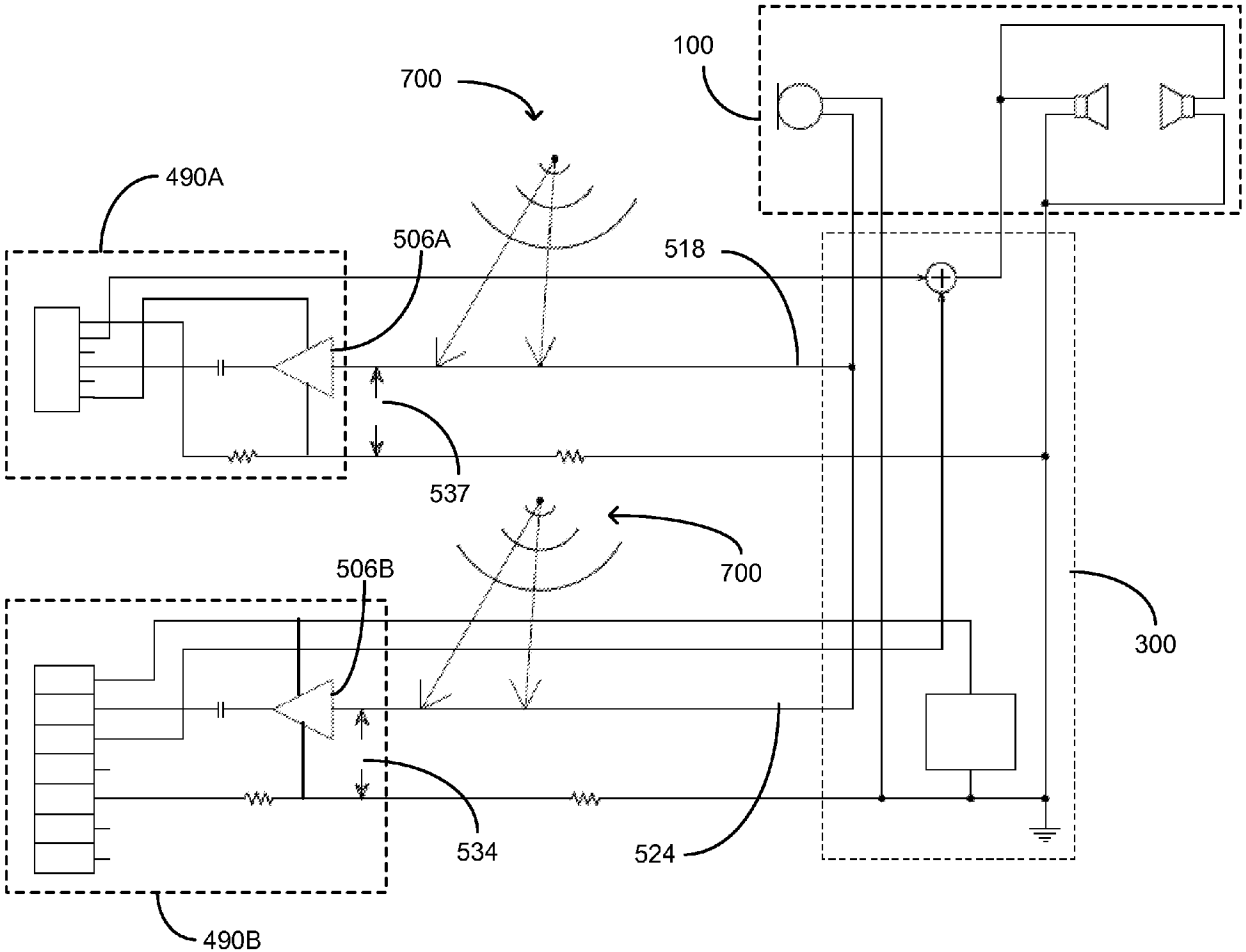
FIG. 7 is a block diagram that is similar to FIG. 2.

FIG. 7 is substantially the same as FIG. 2. Most of the components in FIG. 7 will not be labeled as they are the same as in FIG. 2. The main difference between FIGS. 2 and 7 is that wireless electro-magnetic noise 700 is shown in FIG. 7. This wireless noise induces an undesirable signal in the conductors 518 and 524 which causes a voltage on the input conductor to the amplifier 506A and 506B which is given as V_Noise. The voltage 537 is given as (V_Mic_Sig+)+V_GND1+V_Noise1 which results in a voltage out of the amplifier 506A of V_OUT=((V_Mic_Sig+)+V_GND1+V_Noise1)×GAIN. The voltage drop 534 is given as (V_Mic_ Sig+)+V_GND2+V_Noise2 which results in a voltage out of the amplifier 506B of V_OUT=((V_Mic_Sig+)+V_GND2+V_Noise2)×GAIN. This distortion degrades the quality of the two-way audio communications.

Figure 8:
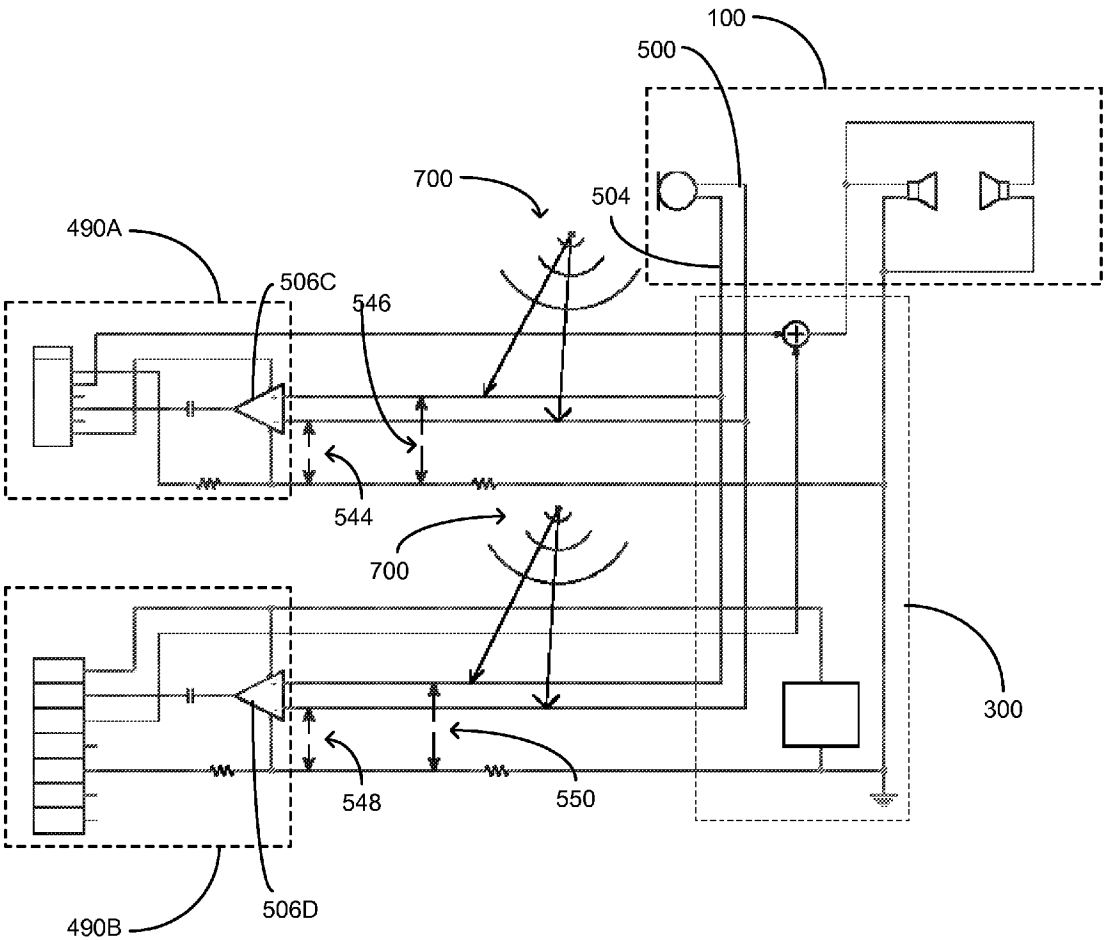
FIG. 8 is a block diagram that is similar to FIG. 3.

FIG. 8 shows a modification to the electrical architecture shown in FIG. 7. Most of the components in FIG. 8 will not be labeled as they are the same as in FIG. 7. The main difference between FIGS. 7 and 8 is that (a) the amplifiers 506A and 506B of FIG. 7 have been replaced with differential amplifiers 506C and 506D, (b) the mic-low conductor 500 is connected to the negative inputs of the differential amplifiers 506C and 506D, and (c) the mic-high conductor 504 is connected to the positive inputs of the differential amplifiers 506C and 506D. The voltage at 544 is given as V_Mic_Low+V_GND1+V_Noise1 and the voltage at 546 is given as V_Mic_High+V_GND1+V_Noise1. So the output voltage of the differential amplifier 506C is (V_Mic_High+V_GND1+V_Noise1−V_Mic_Low−V_GND1−V_Noise1)×GAIN. This equation reduces to (V_Mic_High−V_Mic_Low)×GAIN. The voltage at 548 is given as V_Mic_Low+V_GND2+V_Noise2 and the voltage at 550 is given as V_Mic_High+V_GND2+V_Noise2. So the output voltage of the differential amplifier 506D is (V_Mic_High+V_GND1+V_Noise2−V_Mic_Low−V_GND2−V_Noise2)×GAIN. This equation reduces to (V_Mic_High−V_Mic_Low)×GAIN. As a result, the noise induced (by the electro-magnetic nose) on the input conductors to the differential amplifiers 506C and 506D been eliminated from the output of the differential amplifiers 506C and 506D. This arrangement results in higher quality two-way audio communications.

A number of implementations have been described. Nevertheless, it will be understood that additional modifications may be made without departing from the spirit and scope of the inventive concepts described herein, and, accordingly, other embodiments are within the scope of the following claims.

What is claimed is:

1. An audio communication system including a headset, comprising:

a microphone having two electrical outputs;

a first electro-acoustic driver;

first and second differential amplifiers;

a first electrical conductor for electrically connecting an output of the first differential amplifier with a first audio source device;

a second electrical conductor for electrically connecting an input of the driver with the first audio source device;

a third electrical conductor for electrically connecting an output of the second differential amplifier with a second audio source device; and a fourth electrical conductor for electrically connecting an input of the driver with the second audio source device, one electrical output from the microphone being electrically connected to a positive input of each of the differential amplifiers, the other electrical output from the microphone being electrically connected to a negative input of each of the differential amplifiers.

2. The system of claim 1, further including a first side tone circuit, the output of the first amplifier being provided to an input of the side tone circuit, an output of the side tone circuit being provided to the input of the driver.

3. The system of claim 2, further including a second side tone circuit, the output of the second amplifier being provided to an input of the second side tone circuit, an output of the second side tone circuit being provided to the input of the driver.

4. The system of claim 1, further including a bias voltage detection circuit, wherein when the detection circuit determines that the first conductor is electrically connected to an audio source with a bias voltage above zero, the detection circuit cause a gain decrease in the first differential amplifier.

5. The system of claim 1, wherein the first amplifier is contained within a first connector at the end of a first cable, and the second amplifier is contained within a second connector at the end of a second cable.

6. The system of claim 1, wherein the microphone is a dynamic microphone.

7. The system of claim 1, further including a second electro-acoustic driver, an input of the second driver being electrically connected with the first audio source device via the second electrical conductor.

8. Audio communication cables for use in an audio communication system, comprising:

a first cable and a first differential amplifier, the cable being electrically connectable to a headset such that positive and negative inputs of the amplifier are electrically connected to a microphone of the headset, an output of the amplifier being connectable with a first audio source device, the audio source device being connectable with an input of an electro-acoustic driver of the headset via the cable; and a second cable and a second differential amplifier, the second cable being connectable to the headset such that positive and negative inputs of the second amplifier are electrically connected to the microphone of the headset, an output of the second amplifier being connectable with a second audio source device, the second audio source device being connectable with the driver of the headset via the second cable.

9. The cables of claim 8, further including a first side tone circuit, the output of the first amplifier being provided to an input of the side tone circuit, an output of the side tone circuit being provided to the input of the driver.

10. The cables of claim 9, further including a second side tone circuit, the output of the second amplifier being provided to an input of the second side tone circuit, an output of the second side tone circuit being provided to the input of the driver.

11. The cables of claim 8, further including a bias voltage detection circuit, wherein when the detection circuit determines that the first cable is connected to an audio source with a bias voltage above zero, the detection circuit cause a gain decrease in the first differential amplifier.

12. The cables of claim 8, wherein the first amplifier is part of the first cable, and the second amplifier is part of the second cable.

13. The cables of claim 8, wherein the microphone is a dynamic microphone.

14. The cables of claim 8, further including a second electro-acoustic driver, an input of the second driver being electrically connected with the first audio source device via the first cable.

15. An audio communication system including a headset, comprising:

a microphone having two electrical outputs;

first and second differential amplifiers a bias voltage detection circuit; and first and second electrical conductors, the first conductor electrically connecting an output of the first differential amplifier with a first audio source device, the second conductor electrically connecting an output of the second differential amplifier with a second audio source device, one electrical output from the microphone being electrically connected to a positive input of each of the differential amplifiers, the other electrical output from the microphone being electrically connected to a negative input of each of the differential amplifiers, wherein when the detection circuit determines that the headset is connected to an audio source with a bias voltage above zero, the detection circuit cause a gain decrease in the first differential amplifier.

16. The system of claim 15, further including a first side tone circuit, the output of the first amplifier being provided to an input of the side tone circuit, an output of the side tone circuit being provided to an input of an electro-acoustic driver of the headset.

17. The system of claim 16, further including a second side tone circuit, the output of the second amplifier being provided to an input of the second side tone circuit, an output of the second side tone circuit being provided to an input of an electro-acoustic driver of the headset.

18. The system of claim 15, wherein the first amplifier is part of a first connector towards the end of a first cable, and the second amplifier is part of a second connector towards the end of a second cable.

19. The system of claim 15, wherein the microphone is a dynamic microphone.

20. The system of claim 15, further including an electro-acoustic driver, an input of the driver being electrically connected with the first audio source device via a third electrical conductor.

* * * * *